US005567179A

United States Patent [19]

Voltz

[11] Patent Number: 5,567,179

[45] Date of Patent: Oct. 22, 1996

[54] CONNECTOR SYSTEM FOR COAXIAL CABLES

[75] Inventor: John Voltz, Hockessin, Del.

[73] Assignee: W. L. Gore & Associates, Inc., Newark, Del.

[21] Appl. No.: 387,146

[22] Filed: Feb. 10, 1995

[51] Int. Cl.[6] ..... H01R 13/434

[52] U.S. Cl. ..... 439/578; 439/745

[58] Field of Search ..... 439/578, 579, 439/745

[56] References Cited

U.S. PATENT DOCUMENTS

| | | | |
|---|---|---|---|
| 3,124,407 | 3/1964 | Lazar et al. | 439/745 |
| 3,245,030 | 4/1966 | D'Amico | 439/748 |
| 4,484,792 | 11/1984 | Tengler et al. . | |
| 4,867,707 | 9/1989 | Widdoes | 439/675 |
| 5,032,089 | 7/1991 | Hansel, III | 439/609 |
| 5,190,472 | 3/1993 | Voltz et al. | 439/579 |
| 5,194,020 | 3/1993 | Voltz | 439/579 |
| 5,409,405 | 4/1995 | Bungo | 439/745 |

*Primary Examiner*—Gary F. Paumen
*Attorney, Agent, or Firm*—Victor M. Genco, Jr.

[57] ABSTRACT

An electrical connector system includes a housing, at least one electrical cable assembly, at least one retaining member and a resilient locking member. The housing has formed therethrough at least one retention window and at least one shaped aperture which is formed through a rear portion of the housing. The at least one retaining member is dimensioned to substantially mirror the dimension of the at least one shaped aperture. The at least one retaining member has an internal surface which defines a channel portion having a predetermined diametral dimension. The channel portion terminates to a slot. The at least one retaining member snap-fittingly engages an individual at least one electrical cable. The at least one electrical cable and the at least one retaining member are insertably received by an individual shaped aperture. A resilient locking member is made integral with each at least one retaining member. The resilient locking member is resiliently moveable, back and forth, from a first, retention window engaging position to a second, retention window disengaging position.

24 Claims, 3 Drawing Sheets

CONNECTOR SYSTEM FOR COAXIAL CABLES

FIELD OF THE INVENTION

The present invention relates to a connector system for use in the termination of conductors, such as but not limited to coaxial signal cables, to signal transmission systems.

BACKGROUND OF THE INVENTION

Coaxially shielded cables are well known as the highest fidelity signal wiring for digital signals and analog signals through the microwave frequency range. The advent of large scale integrated circuits has increased the density and complexity of electronic circuitry to the point where coaxially shielded cables are often required for interconnection in high density applications. However, the usefulness of coaxially shielded cables has been limited by cumbersome and time consuming connection methods.

An electrical connector may be defined as a device used to provide rapid, efficient, connect-disconnect service for an electrical conductor. Electrical connectors have been designed for use with precision miniaturized coaxial cables, such as but not limited to the electrical connectors described in the following U.S. Pat. Nos. 4,867,707; 5,032,089; 5,194,020; and 5,190,472.

In particular, U.S. Pat. No. 4,867,707 provides for a shield integrated contact connector for use with individual and coaxial cables. The shield integrated contact connector includes a housing and retainer which are designed to permit modified coaxial cables to be plugged into a linear array of closely spaced standard pins on printed circuit boards and other high density grouped signal transmission configurations. Although, this connector has operated with success during use thereof, the connector does not permit an individual coaxial cable to be freely rotatable to thereby relieve mechanical stress at the connector housing. Additionally, the retainer is physically separable from the housing and the coaxial cable. This design permits the retainer to be lost or otherwise misplaced during use. Also, assembly of the shield integrated contact assembly having a removable retainer is often tedious.

There is a need for an improved connector system for electrical cables, such as but not limited to coaxial cables, which is simple in design, which accommodates individually removable electrical cables, and which relieves mechanical stress upon an individual electrical cable of the connector system. Accordingly, a suitable improved connector system is provided including features more fully disclosed hereinafter.

SUMMARY OF THE INVENTION

In one aspect of the present invention, this is accomplished by providing an electrical connector system which includes a housing, at least one electrical cable assembly, at least one retaining member and a resilient locking member. The housing has formed therethrough at least one retention window and at least one shaped aperture which is formed through a rear portion of the housing. The housing forms an internal cavity portion which defines an interior wall. The at least one electrical cable assembly includes an electrical cable having a circumferentially disposed flange thereupon. The at least one retaining member is dimensioned to substantially mirror the dimension of the at least one shaped aperture. The at least one retaining member has an internal surface which defines a channel portion having a predetermined width dimension. The channel portion terminates to a slot formed in a retaining member bottom portion. The slot has a narrower width dimension than the width dimension of the channel portion. The at least one retaining member snap-fittingly engages an individual at least one electrical cable. A resilient locking member is made integral with each at least one retaining member. The resilient locking member is resiliently moveable, back and forth, from a first position, wherein the resilient locking member is engageable with a predetermined retention window, to a second position, wherein the resilient locking member is disengaged with respect to the retention window.

The foregoing and other aspects will become apparent from the following detailed description of the invention when considered in conjunction with the accompanying drawing figures.

DETAILED DESCRIPTION OF THE INVENTION

Figure 1:
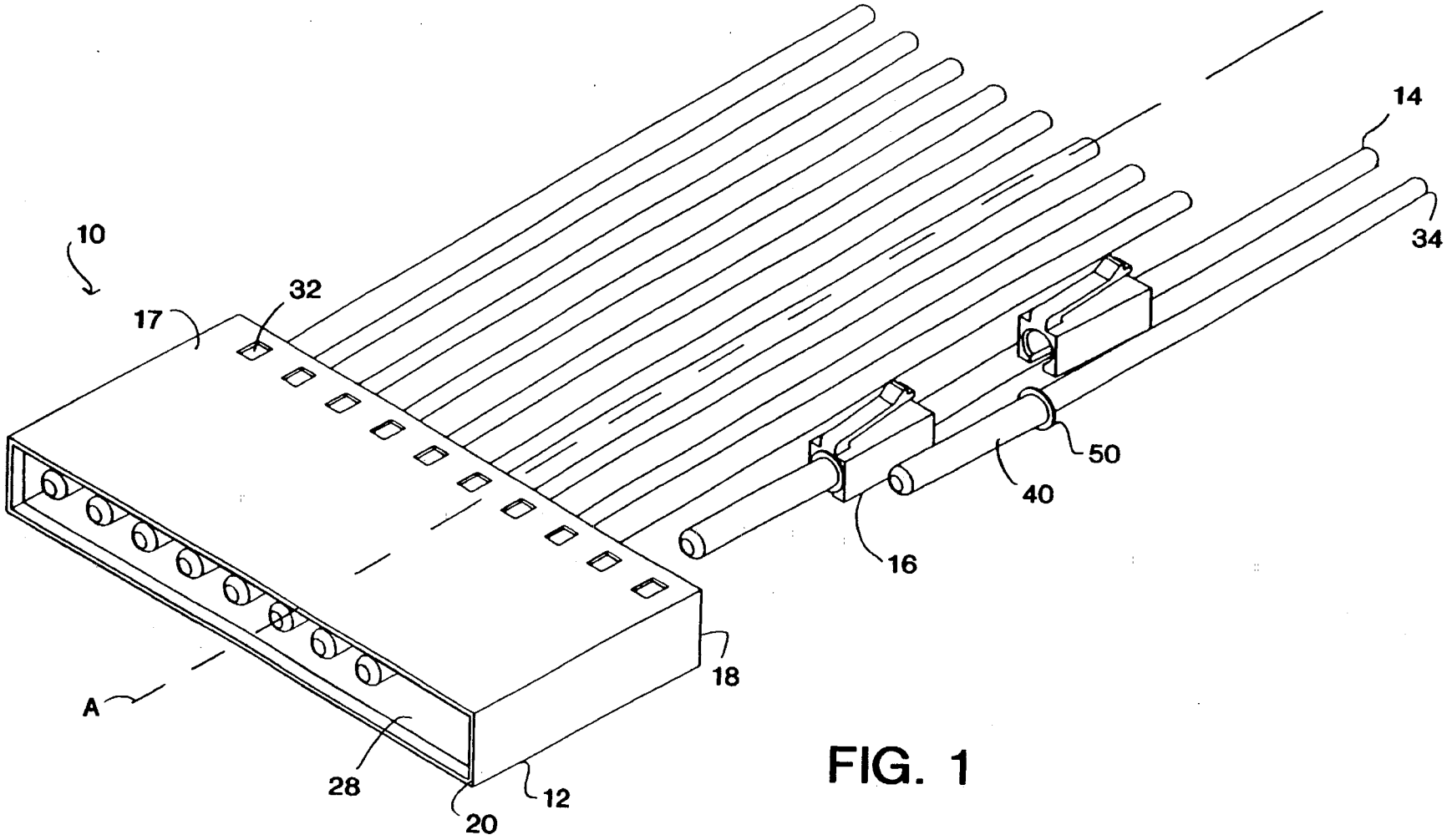
FIG. 1 is a partially exploded, perspective view of a connector system for electrical cables in accordance with the teachings of the present invention.
Figure 2:
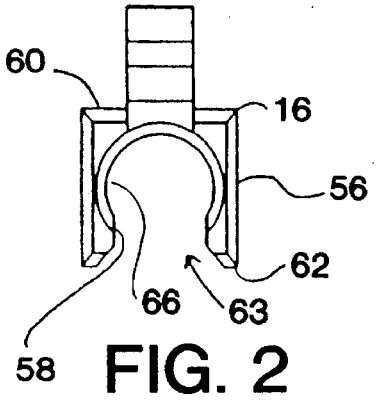
FIG. 2 is a front elevational view of a retainer for the connector system of FIG. 1.
Figure 3:
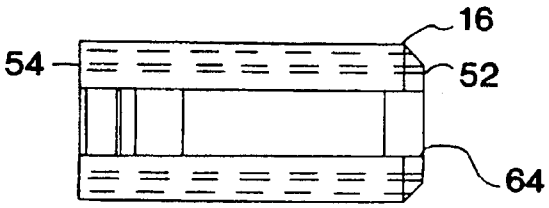
FIG. 3 is a top view of the retainer of FIG. 2.
Figure 4:
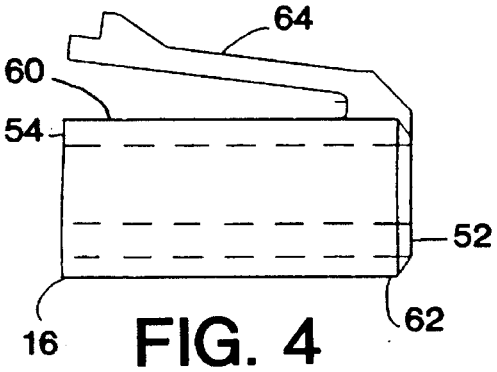
FIG. 4 is a side elevational view of the retainer of FIG. 2 wherein a retainer biasing member is disposed in a relaxed, or unbiased position.
Figure 5:
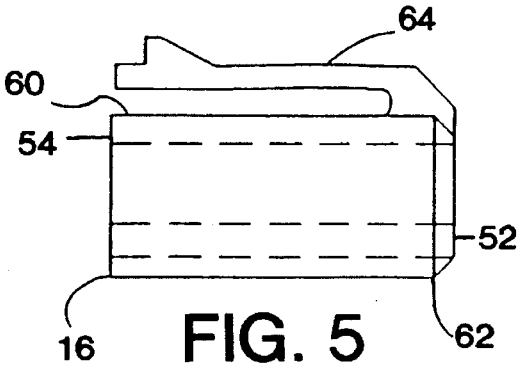
FIG. 5 is a side elevational view of the retainer of FIG. 4 wherein the retainer biasing member is disposed in a compressed position.

Referring now to the drawings, wherein similar reference characters designate corresponding parts throughout the several views, the connector system of the present invention is generally illustrated at 10 in FIG. 1. The connector system includes a housing 12, a plurality of electrical cable assemblies 14 and a plurality of retaining members or retainers 16.

Figure 9:
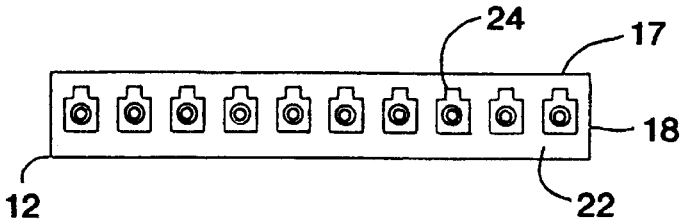
FIG. 9 is a rear elevational view of the housing of the present invention.

The housing 12 locates, in shaped apertures or bores, at least one electrical cable assembly 14. Although FIG. 1 illustrates a single parallel row of electrical cable assemblies 14, the housing 12 may house an individual electrical cable assembly or any number of parallel rows of cable assemblies. The housing is defined by a top portion 17, a rear portion 18 and a front portion 20. As best seen by reference to FIG. 9, the rear portion 18 is defined by a substantially planer surface 22 which has formed therethrough a plurality of shaped apertures 24. The shaped apertures are dimensioned to mirror the outer dimension and shape of the individual retainers 16. As will be described in further detail hereinafter, the individual shaped apertures 24 insertably receive a respective retainer 16.

Figure 6:
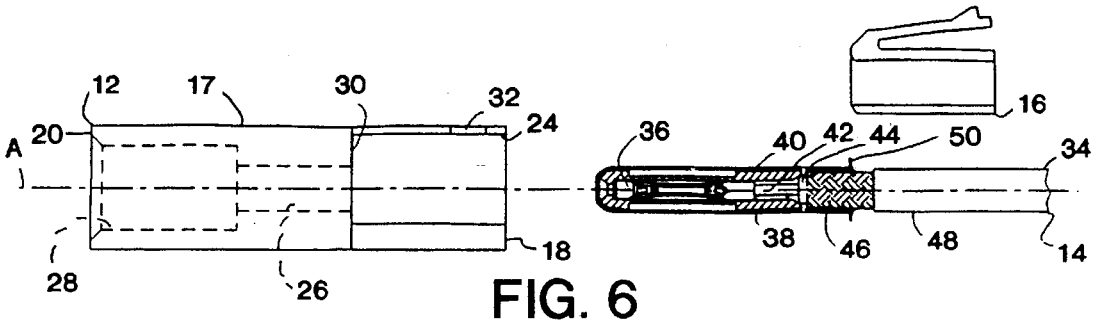
FIG. 6 is a partial, exploded, sectional view of the connector system of FIG. 1.
Figure 7:
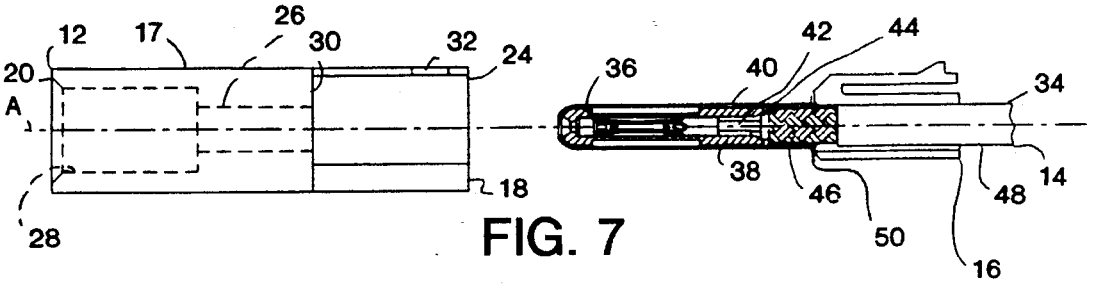
FIG. 7 is a view similar to FIG. 6, wherein the retainer is disposed in an electrical cable engaging position.
Figure 8:
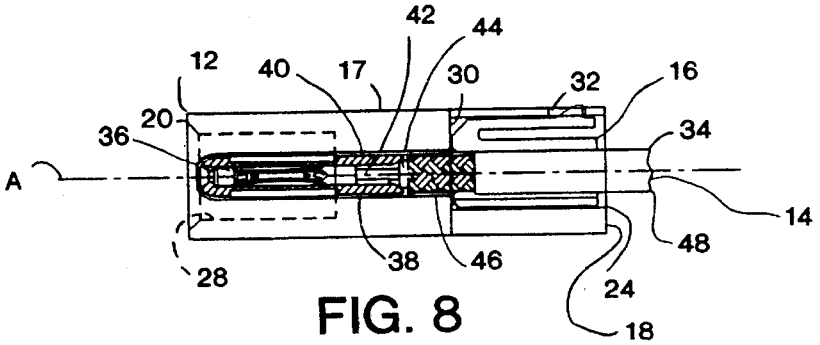
FIG. 8 is a view similar to FIGS. 6 and 7, wherein the electrical cable is insertably disposed within a housing of the connector system.

Referring to FIGS. 1, and 6 through 9, the housing defines a plurality of internal cavity portions. More particularly, starting from the rear 18 of the housing 12, a plurality of first internal cavity portions are defined by the individual shaped apertures 24. Adjacent to each respective first cavity portion is an individual, second, cylindrically shaped cavity 26 which receives a portion of the cable assembly 14. A third cavity portion 28 is dimensioned to receive and support or align a mating connector system. The third cavity portion 28 is open to all the cable assemblies 14 as best seen by reference to FIG. 1. Referring to FIGS. 6 through 8, an interior wall 30 is defined at a juncture between each shaped aperture 24 and a respective cylindrically shaped cavity 26.

As best seen by reference to FIG. 1, a plurality of retention windows 32 are formed through the top portion 17 of the housing 12. The retention windows 32 are generally disposed in a linear arrangement.

The housing 12 may be formed by molding a thermoplastic material, such as a thermoplastic polyester polymer for example, into the desired shape. Additional materials which may be used to form the housing 12 include, but are not limited to, polyphenylene sulfide, polyamide, acetyl, acetylene-butadiene-styrene terpolymer, polytetrafluoroethylene, polyvinyl chloride, polypropylene, polyethylene, polyethylene terephthalate (PET), polybutyline terephthalate (PBT), or liquid crystal polymer (LCP), or other suitable engineering grade thermoplastic materials.

The connector system of the present invention may be employed with any suitable electrical cable, such as but not limited to a coaxial cable assembly. The electrical cable assembly 14 is illustrated in section in FIGS. 6 through 8. The electrical cable assembly 14 may include a coaxial cable 34, a signal contact 36, an insulator 38, and a ground shell 40. The coaxial cable 34 is shown stopped for termination. The illustrated coaxial cable 34 includes a center conductor 42, insulation 44, shielding 46 and a protective polymer jacket 48.

The center conductor 42 preferably comprises a copper, silver-plated copper, or silver-plated copper clad steel wire. Insulation 44 is preferably a porous or solid polytetrafluoroethylene (PTFE), polyethylene, or fluorinated ethylene-propylene copolymer (FEP), or a porous expanded polytetrafluoroethylene material, such as those disclosed in U.S. Pat. Nos. 3,953,566; 3,962,153; 4,096,227; 4,187,390; and 4,902,423. Also, other low dielectric constant porous or solid insulators may be used. Shielding 46 is a material containing electrically conductive metal, such as for example, a round or flat wire braid, helically or spirally wrapped metal-coated polymer tape layers, helically wrapped metal foil, and served metal wire. The round wire braid is preferably made of silver-plated copper or silver-plated copper-clad steel wire. A flat wire braid is preferably formed form silver-plated copper tape. An aluminized polyimide tape, such as KAPTON® tape, or a polyester tape, such as MYLAR® polyester tape is preferred for a helically wrapped metallized polymer tape. The protective polymer jacket 48 may be extruded over the cable or applied by other means. Suitable materials useful for jacket 48 include polytetrafluoroethylene, polyperfluoroalkoxy tetrafluoroethylene (PFA), polyvinyl chloride, or polyurethane, for example.

The ground shell 40 surrounds the insulator 38 which in turn separates ground shell 40 from the signal contact 36. The signal contact 36 is fixedly attached to the center conductor 42, such as by a soldered joint for example. The ground shell 40 includes a circumferentially disposed flange 50, the function of which will be described in further detail hereinafter.

Referring to FIGS. 2 through 5, the retainer 16 is defined by a front portion 52, a rear portion 54, an outer surface 56, an inner surface 58, a top portion 60, and a bottom portion 62. Although the outer surface 56 defines a generally rectangular shape, the retainer may be defined by any desired shape. Whatever the shape of the retainer 16, the shaped aperture 24 must be dimensioned to mirror the shape of the retainer 16 such that the shaped aperture insertably receives the retainer. The inner surface 58 defines a substantially cylindrically shaped channel portion 66 which terminates to a slot 63, which is formed in the bottom portion 62. As best seen by reference to FIG. 2, the slot 63 is generally narrower than the diametral dimension of the cylindrically shaped channel portion 66.

Referring to FIGS. 1, 2, 4 and 5, a resilient locking member 64 is made integral with the top portion 60 of the retainer 16. The resilient locking member is resiliently moveable, back and forth, from a first position (FIG. 8), wherein the resilient locking member is engageable with a predetermined retention window 32, to a second position (FIG. 6), wherein the resilient locking member is disengaged with respect to the retention window.

The retainer 16 may be formed by molding a thermoplastic material into the desired shape. The materials which may be used to form the retainer 16 include but are not limited to polyphenylene sulfide, polyamide, acetyl, acetylene-butadiene-styrene terpolymer, polytetrafluoroethylene, polyvinyl chloride, polypropylene, polyethylene, polyethyline imide (PEI), or other suitable engineering grade thermoplastic materials.

THE OPERATION

The operation of the coaxial connector system of the present invention is best appreciated by sequential reference to FIGS. 6 through 8. Referring to FIG. 6, the housing 12 and each electrical cable assembly 14 are oriented such that each cable assembly enters the housing through the rear portion 18. As illustrated in FIG. 7, the retainer 16 is moveably snap-fit about the coaxial cable 34. The retainer 16 is snap-fit about the coaxial 34 in an orientation wherein the front portion 52 of the retainer 16 is directed toward the flange 50. The retainer 16 engages the coaxial cable 34 in a manner which permits the cable assembly 14 to be rotatable within cylindrically shaped channel 66. An assembled coaxial connector system is illustrated in FIG. 8. As shown therein the retainer fixedly locates a predetermined coaxial cable assembly 14 in a predetermined location with the linear array.

The coaxial cable assembly 14 and the retainer 16 are inserted through the shaped aperture 24 to a location wherein the flange 50 engages the interior wall 30. In this position, the ground shell and the signal contact portion of the electrical cable assembly 14 extend through the cylindrically shaped cavity 26 and into the third cavity portion 28. The flange 50 prevents the cable assembly from being positioned further into the housing 12. After the cable assembly 14 is positioned in such a manner, the retainer 16 is inserted into the shaped aperture 24 to a location wherein the front 52 of the retainer engages the flange 50 and the resilient locking member 64 engages the predetermined retention window 32. When the resilient locking member 64 has engaged the retention window 32, the cable assembly 14 is longitudinally fixedly positioned within the housing 12. However, the cable assembly is freely rotatable about an axis of rotation "A" which is illustrated in FIGS. 1, and 6 through 8.

An individual electrical cable assembly 14 is removable from the housing 12 at a time when the resilient locking member is depressed and disengaged from the retention window 32. This action frees the retainer 16 and the electrical cable assembly 14, thereby permitting the cable assembly and the retainer to be removed from the housing 12.

While this invention has been illustrated and described in accordance with a preferred embodiment, it is recognized that variations and changes may be made therein without departing from the invention as set forth in the following claims.

Having described the invention, what is claimed is:

1. An electrical connector system comprising:

a housing having formed therethrough at least one retention window and at least one shaped aperture which is formed through a rear portion of the housing, the housing defining an internal cavity portion having and interior wall;

at least one electrical cable assembly having an electrical cable defined by a conductor and an insulator, a ground shell surrounding the insulator, the ground shell defining a circumferentially disposed flange, the insulator separating the ground shell from the conductor, the flange engaging the interior wall when the resistant locking member is disposed in the first, retention window engaging position to limit insertion of the electrical cable assembly into the housing;

at least one retaining member which is dimensioned to substantially mirror the dimension of the at least one shaped aperture, the at least one retaining member having an internal surface which defines a channel portion having a predetermined width dimension, the channel portion terminating to a slot formed in a retaining member bottom portion, the slot having a narrower width dimension than the width dimension of the channel portion, the at least one retaining member snap-fittingly engaging an individual said electrical cable; and a resilient locking member made integral with each at least one retaining member, the resilient locking member being resiliently moveable, back and forth, from a first, retention window engaging position to a second, retention window disengaging position.

2. The electrical connector system of claim 1 wherein each at least one cable assembly comprises a shielded coaxial cable.

3. The electrical connector system of claim 1 further including a plurality of shielded coaxial cables.

4. The electrical connector system of claim 3 further including a plurality of said shaped apertures.

5. The electrical connector system of claim 4 wherein the plurality of shaped apertures are arranged through a surface of the rear portion of the housing in a substantially linear arrangement.

6. The electrical connector system of claim 1 further including a plurality of said retention windows formed through a top portion of the housing.

7. The electrical connector system of claim 4 further including a predetermined number of said retention windows which equals the total number of shaped apertures.

8. The electrical connector system of claim 6 wherein the plurality of retention windows are generally disposed in a linear arrangement.

9. The electrical connector system of claim 1 wherein the housing is formed from an engineering grade thermoplastic material.

10. The electrical connector system of claim 9 wherein the housing is formed from a material selected from a group consisting of polyphenylene sulfide, polyamide, acetyl, acetylene-butadiene-styrene terpolymer, polytetrafluoroethylene, polyvinyl chloride, polypropylene, and polyethylene.

11. The electrical connector system of claim 1 wherein the at least one retaining member is formed from an engineering grade thermoplastic material.

12. The electrical connector system of claim 11 wherein the at least retaining member is formed from a material selected from a group consisting of polyphenylene sulfide, polyamide, acetyl, acetylene-butadiene-styrene terpolymer, polytetrafluoroethylene, polyvinyl chloride, polypropylene, and polyethylene.

13. A coaxial cable connector system comprising:

a housing defined by a top portion, a front portion and a rear portion, the top portion having formed therethrough at least one retention window, the rear portion having formed therethrough at least one shaped aperture, the housing forming at least one first cavity portion which is defined by an individual shaped aperture, at least one second cavity portion which communicates with an individual first cavity portion, and a third cavity portion dimensioned to receive and insulate a mating connector system, and wherein an interior wall is defined at a juncture between each at least one first cavity and an adjoining second cavity portion;

at least one shielded coaxial cable assembly including a coaxial cable, a signal contact, an insulator, and a ground shell surrounding the insulator, the ground shell defining a circumferentially disposed flange, the insulator separating the ground shell from the signal contact, the signal contact electrically communicating with a predetermined conductor of the coaxial cable;

at least one retaining member defined by a front portion, a rear portion, an outer surface, an inner surface, a top portion, and a bottom portion, the outer surface defining a predetermined shape which is dimensioned to substantially mirror the dimension of the shaped aperture, the inner surface defining a channel portion having a predetermined width dimension, the channel portion terminating to a slot formed in the bottom portion, the slot having a narrower width dimension than the width dimension of the channel portion; and a resilient locking member made integral with the top portion of each at least one retaining member, the resilient locking member being resiliently moveable, back and forth, from a first, retention window engaging position to a second, retention window disengaging position, and wherein each at least one cable assembly is insertable into the housing through the rear portion thereof to a predetermined location wherein the flange engages the interior wall to limit insertion of the shielded coaxial cable assembly into the housing, each at least one retaining member being moveably snap-fit about an individual coaxial cable, in an orientation wherein the front portion of said retaining member is directed toward the flange and in a manner which permits the cable assembly to be rotatable within the channel portion, each at least one retaining member being insertable within the shaped aperture to a location where the front portion of the retaining member engages the flange and the resilient locking member engages a predetermined retention window thereby fixedly locating the at least one cable assembly within the housing, the at least one coaxial cable assembly being removable from the housing upon locating the resilient locking member to the second retention window disengaging position.

14. The coaxial connector system of claim 13 further including a plurality of shielded coaxial cables.

15. The coaxial connector system of claim 14 further including a plurality of shaped apertures.

16. The coaxial connector system of claim 15 wherein the plurality of shaped apertures are arranged through the rear portion of the housing in a substantially linear arrangement.

17. The coaxial connector system of claim 16 further including at least two parallel linear arrangements of shaped apertures.

18. The coaxial connector system of claim 15 further including a plurality of retention windows formed through the top portion of the housing.

19. The coaxial connector system of claim 18 and wherein the number of retention windows equals the number of shaped apertures.

20. The coaxial connector system of claim 18 wherein the plurality of retention windows are generally disposed in a linear arrangement on the top portion of the housing.

21. The coaxial connector system of claim 13 wherein the housing is formed from an engineering grade thermoplastic material.

22. The coaxial connector system of claim 21 wherein the housing is formed from a material selected from a group consisting of polyphenylene sulfide, polyamide, acetyl, acetylene-butadiene-styrene terpolymer, polytetrafluoroethylene, polyvinyl chloride, polypropylene, and polyethylene.

23. The coaxial connector system of claim 13 wherein the at least one retaining member is formed from an engineering grade thermoplastic material.

24. The coaxial connector system of claim 23 wherein the at least one retaining member is formed from a material selected from a group consisting of polyphenylene sulfide, polyamide, acetyl, acetylene-butadiene-styrene terpolymer, polytetrafluoroethylene, polyvinyl chloride, polypropylene, and polyethylene.

* * * * *